US009209580B2

(12) United States Patent
Rosenberger

(10) Patent No.: US 9,209,580 B2
(45) Date of Patent: Dec. 8, 2015

(54) SYSTEM OF A CO-AXIAL INSERTION-TYPE CONNECTOR AND A CO-AXIAL CABLE

(75) Inventor: Bernd Rosenberger, Tittmoning (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 133 days.

(21) Appl. No.: 14/122,693

(22) PCT Filed: Jun. 5, 2012

(86) PCT No.: PCT/EP2012/002392

§ 371 (c)(1),
(2), (4) Date: Nov. 27, 2013

(87) PCT Pub. No.: WO2012/167917

PCT Pub. Date: Dec. 13, 2012

(65) Prior Publication Data

US 2014/0080357 A1 Mar. 20, 2014

(30) Foreign Application Priority Data

Jun. 7, 2011 (DE) ..... 10 2011 103 531

(51) Int. Cl.
*H01R 24/38* (2011.01)
*H01R 13/622* (2006.01)
*H01R 24/40* (2011.01)

(52) U.S. Cl.
CPC ..... *H01R 24/38* (2013.01); *H01R 13/622* (2013.01); *H01R 24/40* (2013.01)

(58) Field of Classification Search
CPC ..... H01R 2103/00
USPC ..... 439/578, 584, 585
See application file for complete search history.

(56) References Cited

U.S. PATENT DOCUMENTS

| | | | | |
|---|---|---|---|---|
| 2,878,039 | A * | 3/1959 | Hoegee et al. | 285/249 |
| 3,372,364 | A * | 3/1968 | O'Keefe et al. | 439/585 |
| 4,093,335 | A * | 6/1978 | Schwartz et al. | 439/583 |
| 4,168,921 | A * | 9/1979 | Blanchard | 403/19 |
| 4,173,385 | A * | 11/1979 | Fenn et al. | 439/277 |
| 4,688,877 | A * | 8/1987 | Dreyer | 439/584 |
| 5,059,139 | A * | 10/1991 | Spinner | 439/583 |
| 5,211,590 | A * | 5/1993 | Smith et al. | 439/894 |
| 5,435,760 | A * | 7/1995 | Miklos | 439/321 |
| 5,580,278 | A * | 12/1996 | Fowler et al. | 439/607.23 |
| 6,095,828 | A * | 8/2000 | Burland | 439/98 |
| 6,375,509 | B2 * | 4/2002 | Mountford | 439/607.41 |
| 7,252,536 | B2 * | 8/2007 | Lazaro et al. | 439/470 |
| 7,261,594 | B2 * | 8/2007 | Kodama et al. | 439/578 |
| 7,955,131 | B2 * | 6/2011 | Barbier et al. | 439/607.17 |
| 2014/0080357 | A1 * | 3/2014 | Rosenberger | 439/578 |
| 2014/0148044 | A1 * | 5/2014 | Balcer et al. | 439/460 |

FOREIGN PATENT DOCUMENTS

WO 03103103 A1 12/2003

* cited by examiner

*Primary Examiner* — Neil Abrams
(74) *Attorney, Agent, or Firm* — DeLio, Peterson and Curcio LLC; Robert Curcio

(57) ABSTRACT

A system of a coaxial connector and a coaxial cable, wherein the respective outer and inner conductors of the coaxial connector and the coaxial cable are interconnected in an electrically conductive manner, such that the coaxial connector and the coaxial cable engage into each other in a form-fitting and rotationally secured manner. The engaging parts may be in the form of tongues and cut-outs that interfit to prevent rotation.

9 Claims, 3 Drawing Sheets

SYSTEM OF A CO-AXIAL INSERTION-TYPE CONNECTOR AND A CO-AXIAL CABLE

BACKGROUND OF THE INVENTION

1. Field of the Invention

The invention relates to a system of a co-axial insertion-type connector and a co-axial cable, the outer conductors and center conductors of, respectively, the co-axial insertion-type connector and the co-axial cable having electrically conductive connections to one another, and to a method of connecting a system of this kind.

2. Description of Related Art

Standardized under DIN 47 223 is a co-axial insertion-type connector whose center conductor is of an outside diameter of approximately 7 mm and whose outer conductor is of an inside diameter of approximately 16 mm. Co-axial insertion-type connectors to DIN 47 223 are therefore also referred to as 7/16 connectors. Because of the specific ratio between the diameters and with air as a dielectric, a characteristic impedance of approximately 50Ω is obtained between the insertion ends of the center and outer conductors.

A co-axial insertion-type connector designed in accordance with DIN 47 223 in the form of a co-axial plug has, at the insertion end, an end of the center conductor which is in pin form and which is inserted in a corresponding end, in socket form, of the center conductor of a co-axial insertion-type connector in the form of a co-axial coupler. When so inserted, the outer conductor of the co-axial plug makes contact with the outer conductor of the co-axial coupler in both the axial and the radial directions in that the tubular end of the outer conductor of the co-axial plug is pressed against an annular step which is formed by the inner side of the outer conductor of the co-axial coupler. The axial force required to do this is applied by means of a ring nut which is rotatably mounted on the co-axial plug and which is screwed onto a corresponding external thread on the co-axial coupler. This screwed connection at the same time serves to secure the co-axial insertion-type connection against coming loose.

Co-axial insertion-type connectors to DIN 47 223 are suitable to have connected to them co-axial cables in which the effective inside diameter of the outer conductor is preferably 10 to 20 mm. The only stipulations which are made in this case in DIN 47 223 are ones relating to the mechanical strengths to be achieved of the connections between the co-axial insertion-type connector and the co-axial cable. There are no stipulations in DIN 47 223 relating to the actual structural design of the connection.

In practice, the connection between co-axial insertion-type connectors of this kind and the corresponding co-axial cable is made by pushing the cable, by the appropriate end, a short distance into the cable end of the co-axial insertion-type connector and then soldering together the outer surface of the outer conductor of the co-axial cable and the inner surface of the corresponding portion of the outer conductor of the co-axial insertion-type connector. However, this type of connection between a co-axial insertion-type connector and a co-axial cable involves a good deal of effort to make it. Also, the inaccessible soldered area calls for a good deal of cost and effort in checking it to ensure that the soldered connection is a joint of the requisite quality.

SUMMARY OF THE INVENTION

Taking the above prior art as a point of departure, the object underlying the invention was to specify a system which was improved in respect of the connection between a co-axial insertion-type connector and a co-axial cable. The aim was also to specify an improved method of connecting a system of this kind. In particular, the system and method were to make possible the connecting of a co-axial plug and a co-axial cable which was simple but nevertheless of high quality. What the system was also to make possible was simple subsequent testing of the connection for the purposes of quality assurance.

This object is achieved by virtue of the subject matter described herein and identified in the independent claims. Advantageous embodiments of the system according to the invention and the method according to the invention form the subject matter of the respective sets of dependent claims and can be seen from the following description of the invention.

The above and other objects, which will be apparent to those skilled in the art, are achieved in the present invention which is directed to a system comprising a co-axial insertion-type connector and a co-axial cable, the outer conductors and center conductors of, respectively, the co-axial insertion-type connector and the co-axial cable having electrically conductive connections to one another, and the outer conductors of the co-axial insertion-type connector and the co-axial cable engaging in one another by positive engagement in such a way as to be secured against twisting, such that the outer conductor of the co-axial cable, or of the co-axial insertion-type connector, or both, has at least one longitudinal tongue which engages in a cut-out in the co-axial insertion-type connector or the co-axial cable.

The longitudinal tongues of the outer conductors of the co-axial insertion-type connector and the co-axial cable each include cut-outs in which the longitudinal tongues of the other part of the connection engage.

A protective covering may be included which surrounds a portion both of the co-axial insertion-type connector and of the co-axial cable. The protective covering may further include a rigid sleeve.

In a second aspect, the present invention is directed to a method of connecting a system wherein the co-axial insertion-type connector and the co-axial cable include the outer conductors and center conductors of, respectively, having electrically conductive connections to one another, and the outer conductors of the co-axial insertion-type connector and the co-axial cable engaging in one another by positive engagement in such a way as to be secured against twisting, such that the outer conductor of the co-axial cable, or of the co-axial insertion-type connector, or both, has at least one longitudinal tongue which engages in a cut-out in the co-axial insertion-type connector or the co-axial cable, and the co-axial insertion-type connector and the co-axial cable are welded together, and the welding is preferably performed by laser.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
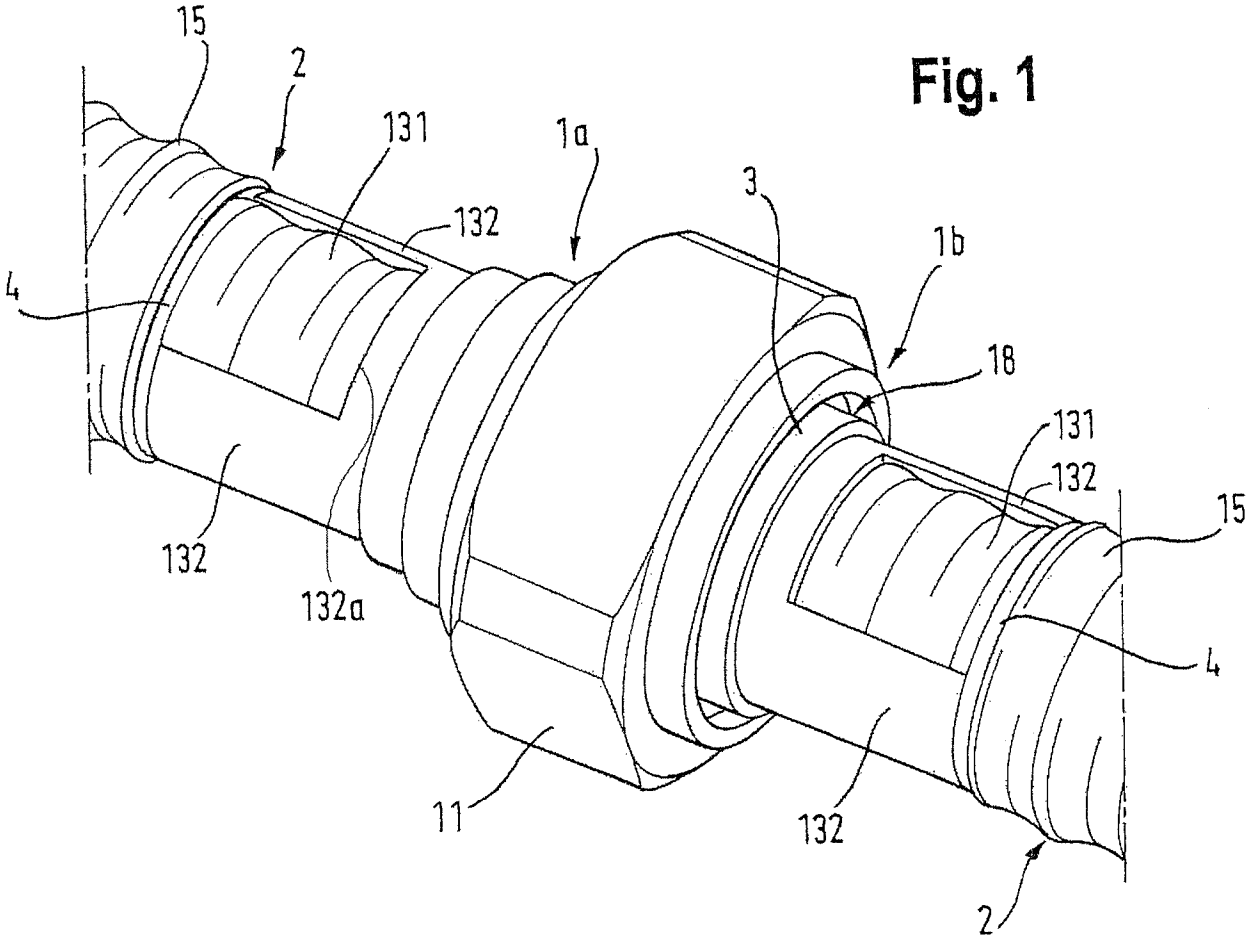
FIG. 1 is an isometric view of a first embodiment of system according to the invention.

In describing the preferred embodiment of the present invention, reference will be made herein to FIGS. 1-3 of the drawings in which like numerals refer to like features of the invention.

The idea underlying the invention is that, by so forming the co-axial insertion-type connector and the co-axial connection that they engage in one another in such a way as to be positively engaged and secured against twisting (i.e. the positive engagement is so designed that it prevents any relative rotation of the two components), an advantageous way of connecting a system comprising these two elements, whose outer and center conductors are connected together by electrically conductive connections, can be achieved. Not only does the positively engaged connection between the co-axial insertion-type connector and the co-axial cable which secures them against relative rotation have advantages in this case when the connections are loaded with a torque, but the design according to the invention may indeed also produce an improved joint configuration as a result of which a connection made by adhesion or coalescence, and in particular by soldering or welding, becomes simpler and better able to be checked.

Provision is preferably made for the outer conductors of the co-axial insertion-type connector and the co-axial cable of the system according to the invention to engage in one another by positive engagement in such a way as to be secured against twisting, because—in comparison with a design (which can also be produced) which is positively engaged and secured against twisting but where the connection is between the two center conductors—on the one hand higher torques can be transmitted and on the other hand the connecting joint produced by the engagement of the co-axial insertion-type connector and the co-axial cable is accessible from the outside, which may simplify connection by adhesion or coalescence.

In a particularly preferred embodiment of the system according to the invention, provision is made for the outer conductor of the co-axial cable and/or of the co-axial insertion-type connector to have at least one longitudinal tongue which engages in a cut-out in the outer conductor of the co-axial insertion-type connector or the co-axial cable. What is meant in this case by "longitudinal tongue" is, in general terms, a projection on the end-face of the outer conductor.

As a particular preference, provision may be made for longitudinal tongues of the outer conductors of both the co-axial insertion-type connector and the co-axial cable to engage in one another (after the fashion of claws). A design of this kind for the system according to the invention may result in a relatively long connecting joint, in the form of a butt joint, which in particular is fully accessible from the outside and which can be connected by means of a square butt seam. Because of the full accessibility, a connection of this kind between a co-axial insertion-type connector and a co-axial cable can not only be soldered but the possibility also exists of its being welded (in particular by means of a laser).

In what is also a preferred embodiment of system according to the invention, provision may be made for a protective covering to be provided which surrounds both a portion of the co-axial insertion-type connector and a portion of the co-axial cable. A protective covering of this kind may for example prevent dirt and moisture from penetrating into the co-axial insertion-type connector. Provision may preferably be made in this case for the protective covering to take the form of a (rigid) sleeve, whereby a further improvement may be made in the ability of the point of connection in the system according to the invention to withstand mechanical loads.

Figure 2:
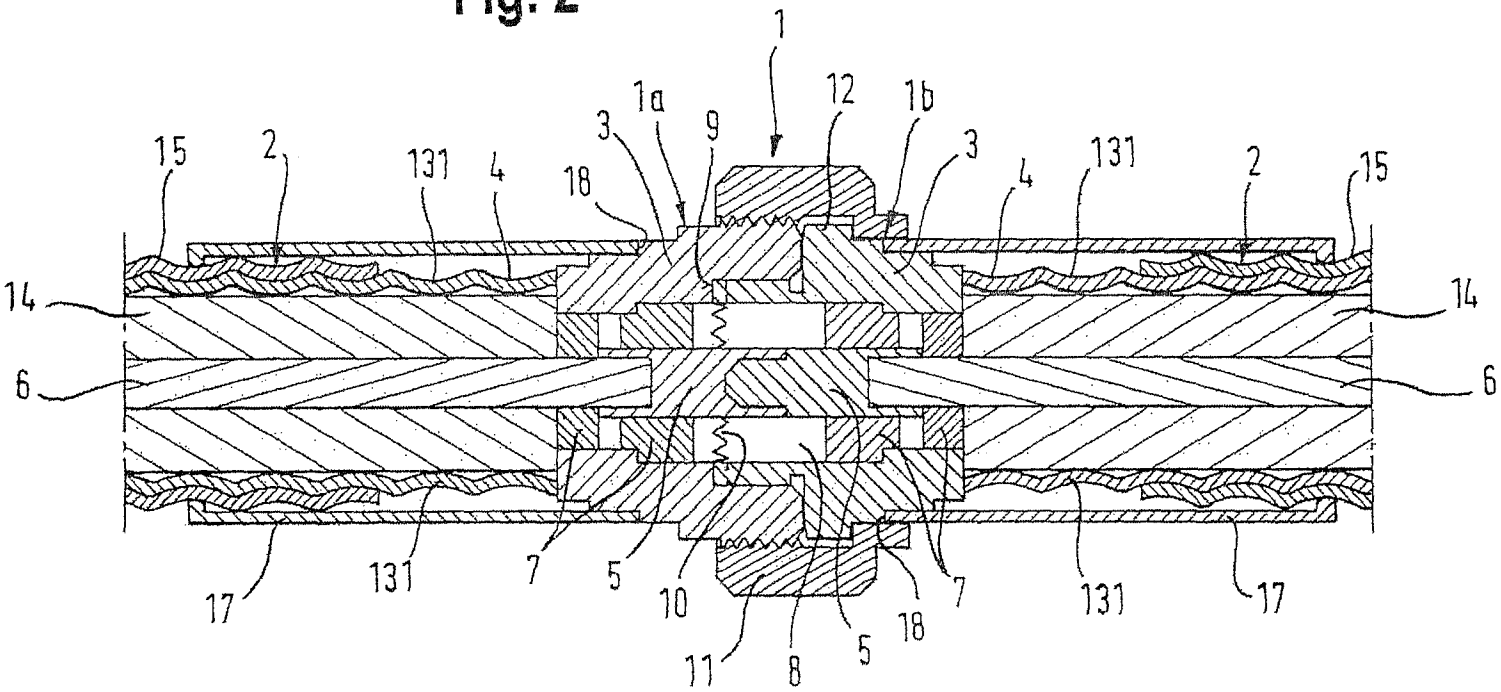
FIG. 2 is a longitudinal section through the system shown in FIG. 1.

FIGS. 1 and 2 show a first embodiment of system according to the invention which comprises a co-axial insertion-type connector 1 and a co-axial cable 2 connected thereto. What are actually shown are two corresponding systems, with the co-axial insertion-type connector 1 of one system taking the form of a co-axial coupler 1*a* and that of the other system taking the form of a co-axial plug 1*b*. However, the structural and functional nature of the connection of the respective co-axial insertion-type connectors 1 to the corresponding co-axial cables 2 is the same for both the systems shown.

Each of the co-axial insertion-type connectors 1 comprises an outer conductor 3 which has an electrically conductive connection to a corresponding outer conductor 4 of the particular co-axial cable 2 concerned. Each of the co-axial insertion-type connectors 1 also comprises a center conductor 5 which has an electrically conductive connection to a corresponding center conductor 6 of a co-axial cable 2. The outer conductor 3 and center conductor 5 of each of the co-axial insertion-type connectors 1 are connected together across respective ones of two insulators 7 in disc form, there being, where the co-axial plug-in connection formed by the two co-axial insertion-type connectors 1 is in the plugged-together state, an annular space 8 in the region of the insertion ends of the outer conductor 3 and center conductor 5 in which air is provided as a dielectric to insulate the outer conductor 3 and center conductor 5.

The first co-axial insertion-type connector 1, which is shown on the left-hand side of FIGS. 1 and 2, takes the form of a co-axial coupler 1*a*, the insertion end of the center conductor 5 taking a bush-like form to receive a corresponding end, in pin form, of the center conductor 5 of the second co-axial insertion-type connector, which takes the form of a co-axial plug 1*b*. Formed on the inside of the outer conductor 3 of the co-axial coupler 1*a*, there is also a radial step 9 which acts as an axial stop in said outer conductor and, at the same time, as an axial surface for contact thereof for the corresponding insertion end of the outer conductor 3 of the co-axial plug 1*b*. The axial surfaces for contact of the outer conductors 3 of the two co-axial insertion-type connectors 1 shown in FIGS. 1 and 2 are of a saw-tooth form, i.e. they form a plurality of identical projections 10 which are arranged at the same pitch and taper to a point and which engage between projections 10 just like them from the surface for contact of whichever is the other outer conductor 3.

To connect the two co-axial insertion-type connectors 1 securely, the co-axial plug 1*b* is provided with a ring nut 11 whose internal thread engages on a corresponding external thread on the co-axial coupler 1*a*, the two co-axial insertion-type connectors 1 being pressed against one another axially by screwing the two threaded parts together. When they are so pressed, the ring nut 11, which is rotatably mounted on the outer conductor 3 of the co-axial plug 1*b*, is supported against a radial projection 12 on the outer conductor 3 of the co-axial plug 1*b*.

Also, the co-axial cables 2 have an insulator 14 which is arranged between the outer conductor 4 and center conductor 6 and a protective sheath 15, of material which is not (electrically) conductive, which surrounds the outer conductor 4.

Both the respective cable ends of the outer conductors 3 of the co-axial insertion-type connectors 1 and the respective connector ends of the outer conductors 4 of the co-axial cables 2 are formed to have longitudinal tongues 131, 132 which are situated opposite each other radially. Tongues 131 are located on the outer conductor of the co-axial cable, and tongues 132 are located on the co-axial insertion-type connector. Between each pair of these longitudinal tongues 131, 132 are Ruined two cut-outs 131*a*, 132*a* in which the longitudinal tongues 131, 132 of the other part of the connection, respectively, are able to engage. Cut-out 131*a* is a cut-out of the outer conductor of the co-axial cable, and cut-out 132*a* is a cut-out of the co-axial insertion-type connector. This produces a connection between the outer connectors 3,4 of the given co-axial insertion-type connector 1 and of the associated co-axial cable 2 which is secured against twisting by positive engagement, there also being formed a butt joint which is fully accessible from the outside because it extends at the surface for its entire length (see FIG. 1) and which enables the two outer conductors 3,4 to be joined by soldering or even by (laser) welding in a way which is easy and can, in particular, also be checked satisfactorily.

A connection between the respective center conductors 5, 6 of the given co-axial insertion-type connector 1 and the associated co-axial cable 2 is obtained by virtue of the fact that the connector end of the center conductor 6 of the co-axial cable 2 projects beyond the end of the outer conductor 4 and the insulator 15 of the co-axial cable 2, whereby said connector end can be inserted in the cable end in bush form of the center conductor 5 of the given co-axial insertion-type connector 1.

Figure 3:
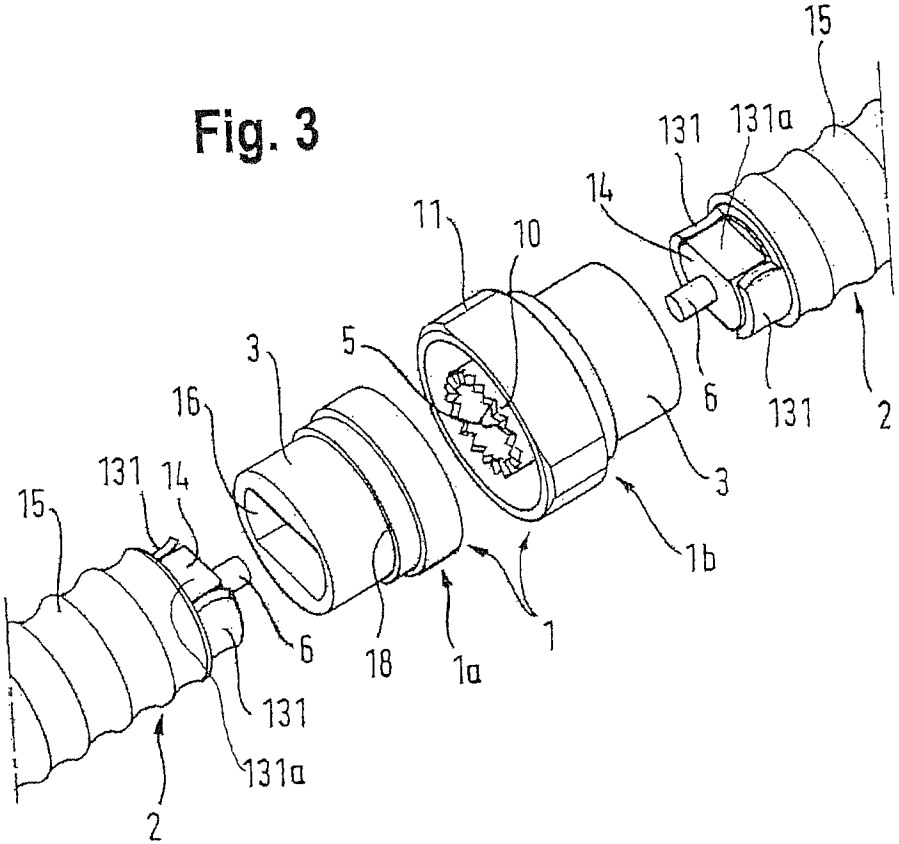
FIG. 3 is an exploded isometric view of a second embodiment of system according to the invention.

The embodiment of system according to the invention which is shown in FIG. 3 differs from that shown in FIGS. 1 and 2 in essence in the design of the cable end of the outer conductor 3 of the given co-axial insertion-type connector 1. Said co-axial insertion-type connector 1 is of a cylindrical form (on the outside), there being provided on the inside a recess in the form of a transverse slot 16 (having parallel side-walls) in which the longitudinal tongues 131 of the outer conductor 4 of the given co-axial cable and the portion which is situated between them of the insulator 14 thereof can in turn be inserted. This embodiment produces a connecting joint which extends round in an annular loop and which once again makes joining possible by soldering or (laser) welding. Alternatively or in addition, a joint between the two outer conductors 3, 4 of the given co-axial insertion-type connector 1 and of the associated co-axial cable 2 can also be obtained by joining the outer surfaces of the two longitudinal tongues 131 of the outer conductor 4 of the co-axial cable 2 and the corresponding portion of the inside of the outer conductor 4 of the co-axial insertion-type connector 1 by a joint made by adhesion or coalescence and in particular by soldering.

The systems according to the invention which are shown in the drawings may in addition be provided with a protective covering in the form of a (rigid) sleeve 17 such as is shown in FIG. 2. The sleeve 17 is supported at one of its ends against a surrounding step 18 on the outer conductor 3 of the co-axial insertion-type connector 1 concerned. The other end of the sleeve 17 is angled in at a right angle and thus engages against the protective sheath 15 of the co-axial cable 2 concerned.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A system comprising a co-axial insertion-type connector and a co-axial cable, the outer conductors and center conductors of, respectively, the co-axial insertion-type connector and the co-axial cable having electrically conductive connections to one another, and the outer conductors of the co-axial insertion-type connector and the co-axial cable engaging in one another by positive engagement in such a way as to be secured against twisting, such that the outer conductor of the co-axial cable, or of the co-axial insertion-type connector, or both, has at least one longitudinal tongue which engages in a cut-out in the co-axial insertion-type connector or the co-axial cable.

2. The system of claim 1 wherein the longitudinal tongues of the outer conductors of the co-axial insertion-type connector and the co-axial cable each include cut-outs in which the longitudinal tongues of the other part of the connection engage.

3. The system of claim 1 including a protective covering which surrounds a portion both of the co-axial insertion-type connector and of the co-axial cable.

4. The system of claim 3 wherein the protective covering includes a rigid sleeve.

5. A method of connecting a system having a co-axial insertion-type connector and the co-axial cable, wherein the co-axial insertion-type connector and the co-axial cable include the outer conductors and center conductors of, respectively, having electrically conductive connections to one another, and the outer conductors of the co-axial insertion-type connector and the co-axial cable engaging in one another by positive engagement in such a way as to be secured against twisting, such that the outer conductor of the co-axial cable, or of the co-axial insertion-type connector, or both, has at least one longitudinal tongue which engages in a cut-out in the co-axial insertion-type connector or the co-axial cable, and the co-axial insertion-type connector and the co-axial cable are welded together.

6. The method of claim 5 wherein the welding is done by laser.

7. The system of claim 2 including a protective covering which surrounds a portion both of the co-axial insertion-type connector and of the co-axial cable.

8. The system of claim 7 wherein the protective covering includes a rigid sleeve.

9. A system comprising a co-axial insertion-type connector and a co-axial cable, the outer conductors and center conductors of, respectively, the co-axial insertion-type connector and the co-axial cable having electrically conductive connections to one another, and the outer conductors of the co-axial insertion-type connector and the co-axial cable engaging in one another by positive engagement without relative rotation between the co-axial cable and the co-axial insertion-type connector, in such a way as to be secured against twisting, such that the outer conductor of the co-axial cable, or of the co-axial insertion-type connector, or both, has at least one longitudinal tongue which engages in a cut-out in the co-axial insertion-type connector or the co-axial cable.

* * * * *